United States Patent [19]

Kawakami et al.

[11] Patent Number: 4,981,375

[45] Date of Patent: Jan. 1, 1991

[54] NON-PRINTING CARRIAGE MOVEMENT TO INDICATE MARGIN SIZE

[75] Inventors: Yasushi Kawakami; Atsuko Kawasumi; Tomoko Miura, all of Nagoya; Keiichi Hirata, Kuwana; Tomohiro Ban, Iwakura; Akihiro Furukawa, Nagoya, all of Japan

[73] Assignee: Brother Kogyo Kabushiki Kaisha, Nagoya, Japan

[21] Appl. No.: 325,244

[22] Filed: Mar. 17, 1989

[30] Foreign Application Priority Data

Mar. 17, 1988 [JP] Japan ..... 63-64084

[51] Int. Cl.[5] ..... B41J 21/17

[52] U.S. Cl. ..... 400/76; 400/279; 400/706

[58] Field of Search ..... 400/76, 279, 342, 63, 400/64, 706

[56] References Cited

U.S. PATENT DOCUMENTS 4,403,301 9/1983 Fessel ..... 400/279
4,754,428 6/1988 Schultz ..... 400/76

FOREIGN PATENT DOCUMENTS 209185 9/1986 Japan ..... 400/76
128774 6/1987 Japan ..... 400/76

*Primary Examiner*—David A. Wiecking
*Assistant Examiner*—Steven S. Kelley
*Attorney, Agent, or Firm*—Kane, Dalsimer, Sullivan, Kurucz, Levy, Eisele and Richard

[57] ABSTRACT

In a printing device, it is possible to automatically place a print head on the peripheral positions of the print area without actual printing operation.

By employing the above arrangement, an operator can exactly determine a proper size of print sheet for the text to be printed, with no waste of sheet and printing time.

12 Claims, 13 Drawing Sheets

FIG. 3(B)
FIG. 3
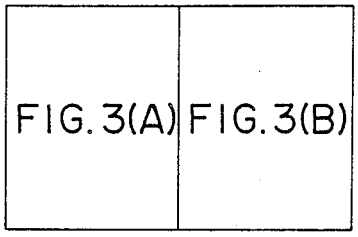
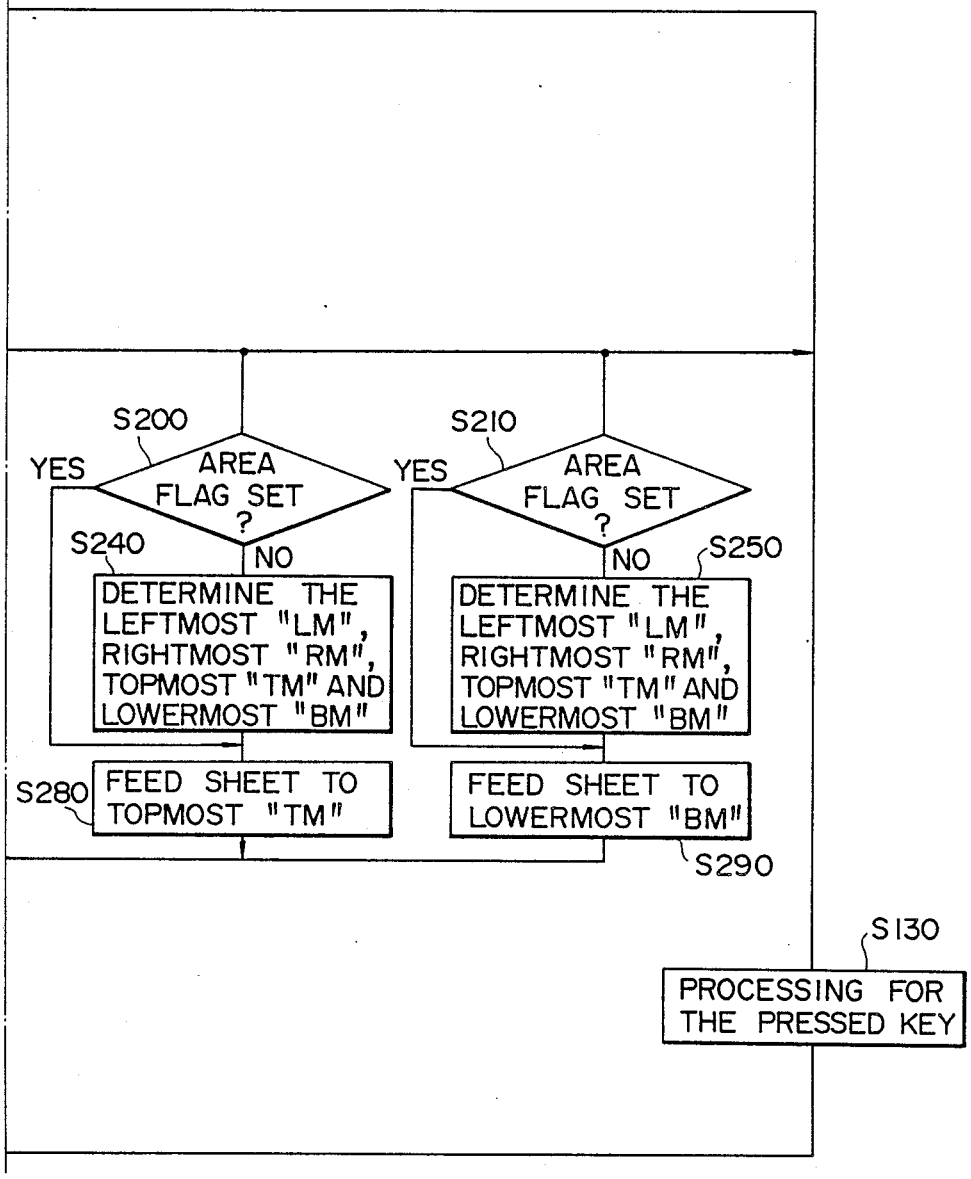

FIG. 5(B)
FIG. 5
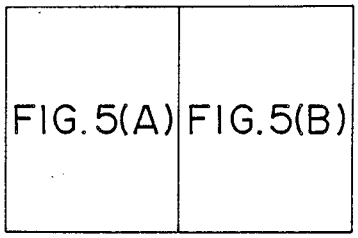
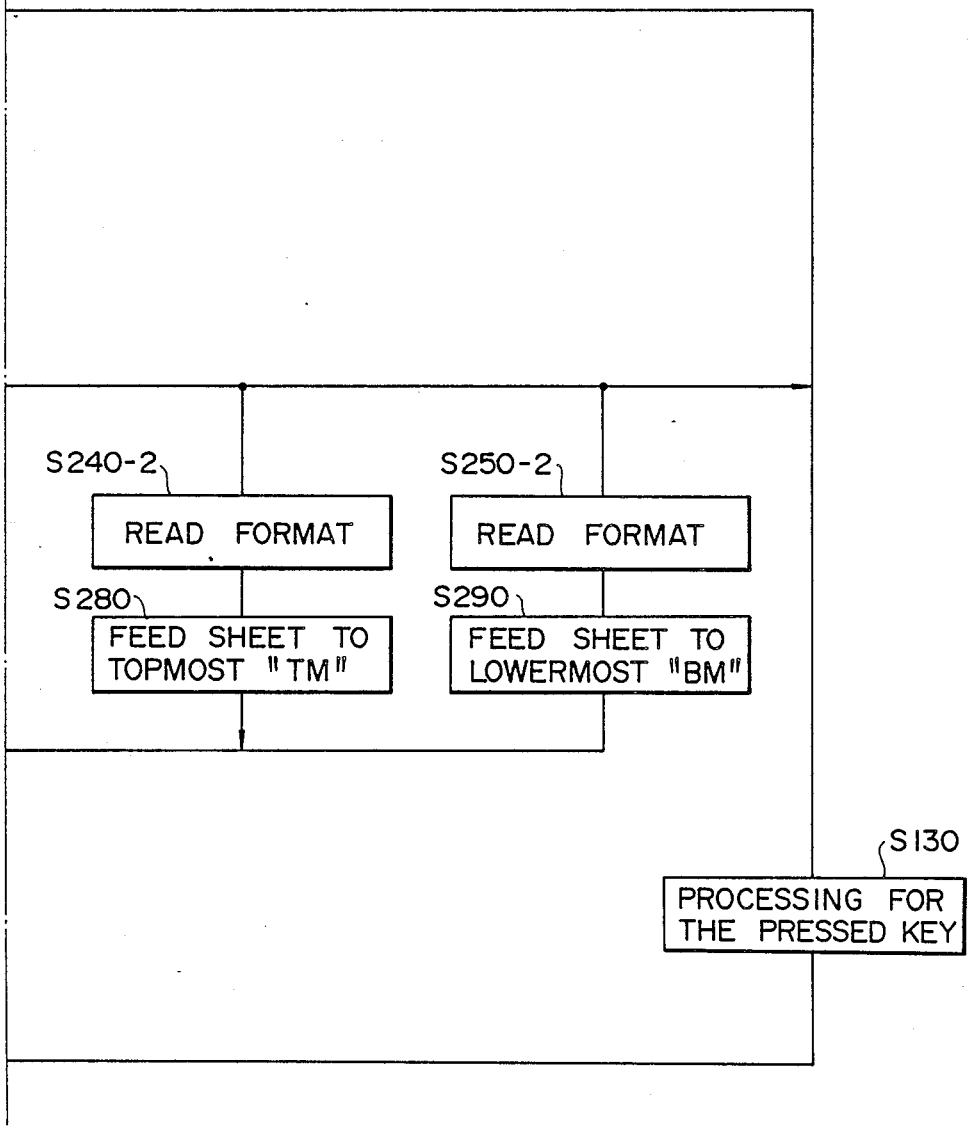

NON-PRINTING CARRIAGE MOVEMENT TO INDICATE MARGIN SIZE

BACKGROUND OF THE INVENTION

This invention relates to a printing device, and more particularly, to a printing device capable of confirming a print area prior to executing an actual printing operation so that an operator is able to select a suitable sheet form.

Conventionally, a printing device such as an electronic typewriter has been provided with a print head unit operated for printing characters, symbols and/or figures on a printing medium such as a paper sheet. The print head unit is mounted on a carriage so as to be movable by a carriage drive mechanism in a direction perpendicular to a sheet feed direction.

Further, recent electronic typewriters have been arranged such that right and left margins as well as top and bottom margins can be freely set so far as it is physically allowed. This makes it possible to execute a printing operation in consideration of the interval ruled lines, and the length of a header or a footer, provided on a printed form sheet.

However, when a text data, for instance, which has already been prepared and stored in a text file memory is to be printed out, it is necessary to confirm the margins of the print area, having been set, of the text file to decide on the type of the print sheet for use. That is, without specifying how wide the margins of print area are, printing may go outside the print sheet or over the header or the footer.

In order to solve the above problem, selection of the sheet type may be done by checking the file information on a display before a printing operation is executed. For instance, the text itself may be shown on the display or the values assigned to the margins may be indicated, whereby the result of printing can be estimated by referring to the scale provided on a printer. However, a real state of printing could hardly be obtained by this way, because it has been unlikely that the carriage is moved exactly as indicated by the values or the indication on the display because of possible hardware errors or software incompatibilities.

SUMMARY OF THE INVENTION

It is therefore an object of the invention to provide an improved printing device capable of confirming the print area without executing printing operation, so that an operator can exactly determine a proper size of print sheet for the text to be printed and can newly set margins for a sheet to be printed thereon.

For this purpose, according to the invention, there is provided a printing device for printing one of text files being stored in memory means, which comprises; select means for selecting one of text files to be printed, print means including a print head unit for printing the content of the text file selected by said select means; search means for searching the most outside peripheral position data of the print area in said text file selected by said select means; and control means for controlling said print means so as to place said print head unit to the positions corresponding to the most outside peripheral position data of the print area searched by said search means.

DESCRIPTION OF THE ACCOMPANYING DRAWINGS

FIGS. 3A through 7D are flow charts showing control processings exectuted by an electronic control system shown in FIG. 2.

DESCRIPTION OF THE EMBODIMENTS

Figure 1:
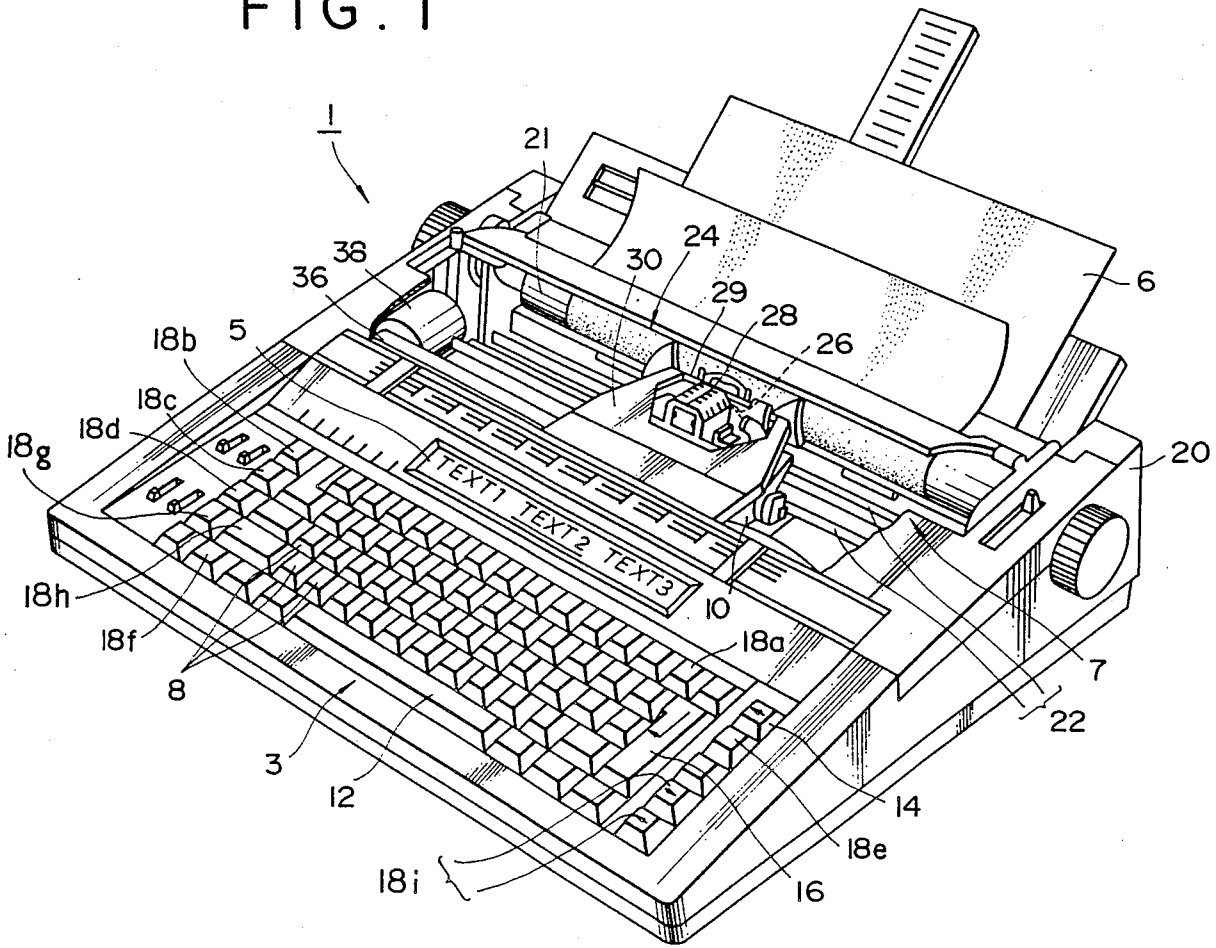
FIG. 1 is a perspective schematic view showing an electronic typewriter embodying the invention.

FIG. 1 showsdan and electronic typewriter 1 embodying the invention, which comprises a keyboard 3 with a number of keys, a liquid crystal panel 5 for displaying characters and/or symbols, and a printer 7 for printing characters and/or symbols on a print sheet 6.

The keyboard 3 consists of multiple keys such as character keys 8 for entering alphanumerical characters, numerals and symbols, and function keys such as a space key 12 for moving a carriage 10, which is described later, by one column to the right, a backspace key 14 for moving the carriage 10 (a print hammer 28) to the left by one column, a return key 16 for rotating a platen 21, which is described later, by one line in a line-feed direction while moving the carriage 10 to the left margin, a print key **18*a* for executing printing of the content of a text file stored in a text memory to be later described, a right and left margin key 18*b* for placing the carriage 10 (a print hammer 28) to right and left margin position with selection between right and left by means of a shift key 18*h*, a right and left margin set key 18*c* for setting right and left margins with selection between right and left by means of the shift key 18*h*, a top and bottom margin set key 18*d* for setting top and bottom margins with selection between top and bottom by means of the shift key 18*h*, a line and page format key 18*e* for initiating the processing for setting right and left margins and top and bottom margins with selection between right/left and top/bottom by means of the shift key 18*h*, an end key 18*f* for terminating a text preparing processing, a top and bottom margin key 18*g* for placing the carriage 10 (a print hammer 28) to top and bottom margin position with selection between top and bottom by means of the shift key 18*h***, and others.

The liquid crystal panel 5 visually indicates the data corresponding to the codes inputted through the keyboard 3 and messages for an operator sent from an electric control unit 50, which will be described later, equipped in a main unit 20. The panel 5 has a capacity to represent one data line composed of 40 columns.

The printer 7 is provided with a platen 21 rotatably carried by the main unit 20 to retain a piece of print sheet 6, a pair of guide bars 22, 22 provided in parallel with the platen 21, and the carriage 10 mounted on and moved along the pair of guide bars 22, 22. The platen 21 is adapted to rotate forward and backward by means of a stepping motor 39 (see FIG. 2).

The carriage 10 has mounted thereon a print assembly 24 for printing characters and/or symbles on the print sheet 6. The print assembly 24 consists of a disc type-wheel 26, a print hammer 28 for hammering the back of the type on the type-wheel 26 and a ribbon cassette 30 accommodating a print ribbon 29. The general structure and operation of the print assembly 24 is similar to those disclosed the U.S. Pat. Nos. 4472073 and 4644477. Engaged with the carriage 10 is a timing belt 36 which is hung around a drive pulley, not shown, mounted on the rotary shaft of a stepping motor 38.

Figure 2:
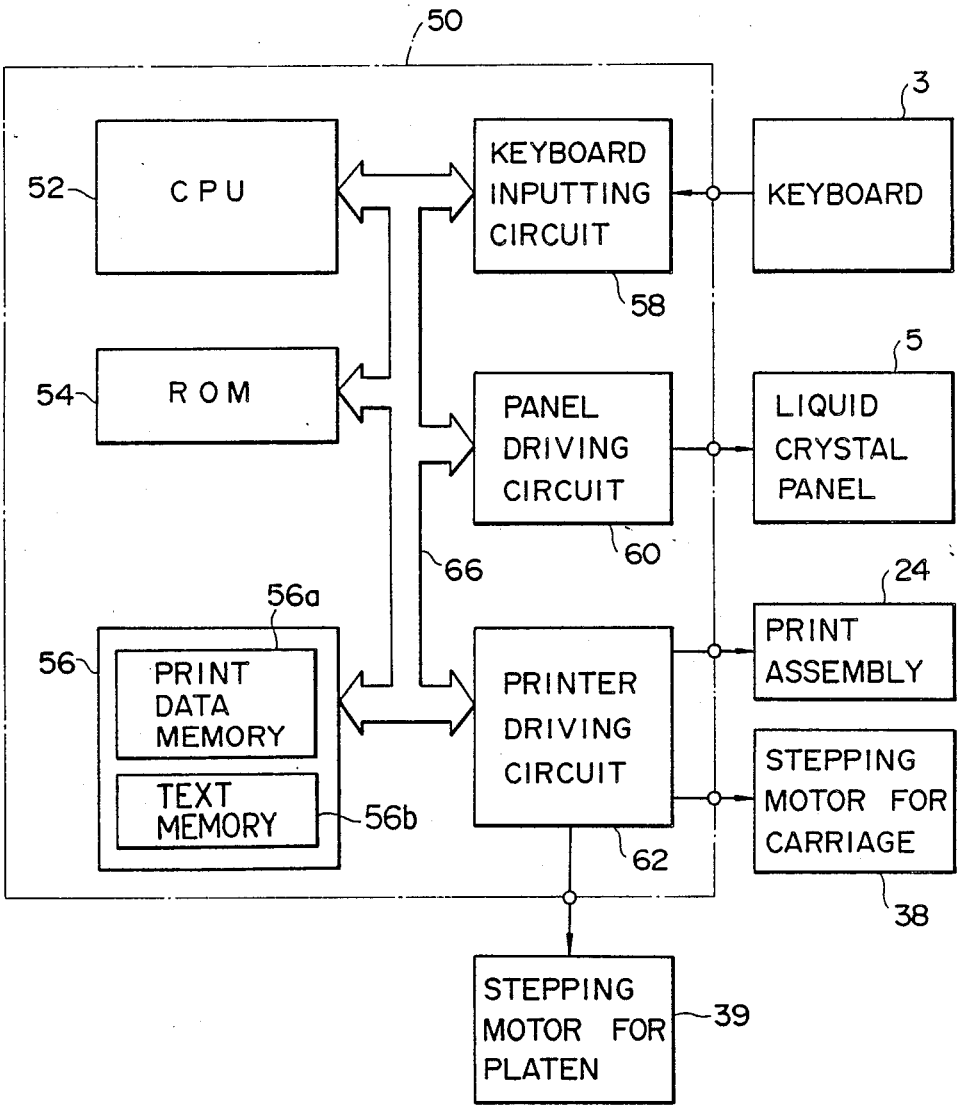
FIG. 2 is a block diagram of the electronic typewriter shown in FIG. 1.

As shown in FIG. 2, the keyboard 3, the liquid crystal panel 5 and the printer 7 mentioned above are all electrically connected with an electronic control circuit 50 incorporated in the main unit 20. The electronic control circuit 50 is constituted by a known CPU (Central Processing Unit) 52, a ROM (Read Only Memory) 54 with control programs and data stored in advance, a RAM (Random Access Memory) 56 capable of reading and writing data. They are further electrically connected to a keyboard inputting circuit 58, a panel driving circuit 60, a printer driving circuit 62 and so on by means of a common bus 66. The CPU 52 tentatively reads and writes data into and out of the RAM 56, required to execute the programs stored in the ROM 54, while executing subsequent data input and output processings. In particular, a key entry takes place through the keyboard 3 by means of the keyboard inputting circuit 58; the data inputted through the keyboard 3 are indicated on the liquid crystal panel 5 by way of the panel driving circuit 60; the data are printed on the print sheet 6 by driving the print assembly 24 by means of the printer driving circuit 62; and the carriage 10 is moved to a desired position with respect to the print sheet 6 by driving the stepping motor 38 for the carriage 10 and the stepping motor 39 for the platen 21 by means of the printer driving circuit 62.

The RAM 56 includes a print data memory **56*a* (equivalent to a so-called correction buffer) which stores a certain volume of the text data printed by the print assembly 24, a text memory 56*b* which stores a plurality of text file data with each file name data and format data inputted through the keyboard 3**, and further includes memories for various counters.

Flow charts for the main control processing to be executed by the aforementioned electronic control circuit 50 is shown in FIGS. 3 through 7.

When the power is turned on, the electronic control circuit 50 is ready for a key input (S110). If the key input is executed, it is examined whether it is the print key **18*a* (S120). If it is any key other than the print key 18*a*, the processing shich corresponds to the operated key is executed (S130). If it is the print key 18*a*, the file names of the text files stored in the text memory 56*b* of the RAM 56 are displayed on the liquid crystal panel 5, with a block cursor placed on the first text file name (S140). Another key input is then awaited (S150). Subsequent processing depends on which key is pressed (S160): (1) If it is one of the cursor keys 18*i*, the block cursor is moved in the indicated direction file name by file name (S170). The file to be printed is thus to be selected, then returning to the key input awaiting state (S150). (2) If the margin key 18*b* or 18*g* is pressed, the following processing takes place: It is examined with reference to an area flag whether or not the processing such as format reading to be described later has been already done (S180–210). If the area flag has not yet been set, the format of the file designated by the block cursor is read. Furthermore, the leftmost position of the left margin positions, the rightmost position of the right margin, the topmost position of the top marginpositions, and the lowermost position of the bottom margin positions are determined in dependence on the multiple format data, with the area flag then being set (S220–250). The area flag described above is reset in case that the processing exits the file select mode. It is reset, in case that, for instance, step 130, 170 or 320** is executed.

Figure 8A:
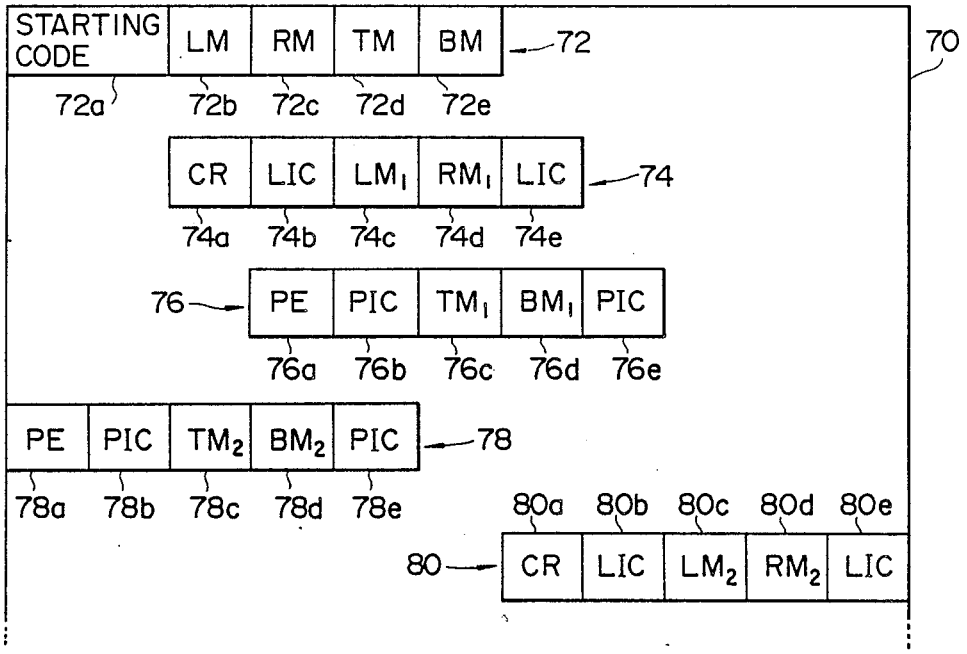
FIGS. 8 (A) and 8 (B) are illustrative views showing file data configurations.

FIG. 8(A) shows the main configuration of the text file data 70. Format data 72–80 are located at the beginning and other selected places of the text file data 70. That is, the file data 70 contains at its beginning a starting code **72*a*, and subsequently, a left margin data (LM) 72*b*, a right margin data (RM) 72*c*, a top margin data (TM) 72*d*, and a bottom margin data (BM) 72*e*. The text file data further includes a line format data 74 and 80 with left margin data (LM) 74*c* and 80*c* and right margin data (RM) 74*d* and 80*d* placed between line identification codes (LIC) 74*b* and 74*e* and between 80*b* and 80*e*. Likewise, there are page format data 76 and 78 with top margin data (TM) 76*c* and 78*c* and bottom margin data (BM) 76*d* and 78*d* placed 78*c* and bottom margin data (BM) 76*d* and 78*d* placed between page identification codes (PIC) 76*b* and 76*e* and 78*b* and 78*e*. Attached to each format data 74 to 80 is line feed codes (CR) 74*a* and 80*a* and page end codes (PE) 76*a* and 78*a***.

Accordingly, a print format is changed on the point at which each of the format data is located, and a printing operation is further executed in accordance with a new print format.

The processing in steps 220 through 250 is thus to read data from such several format data 72 through 80 and determine their leftmost, rightmost, topmost and lowermost margins. In such margin data, the right and left margin data are represented as the distance from the left end of the platen 21 and the top and bottom margins are as the distance from the top end of the print sheet 6.

Figure 4:
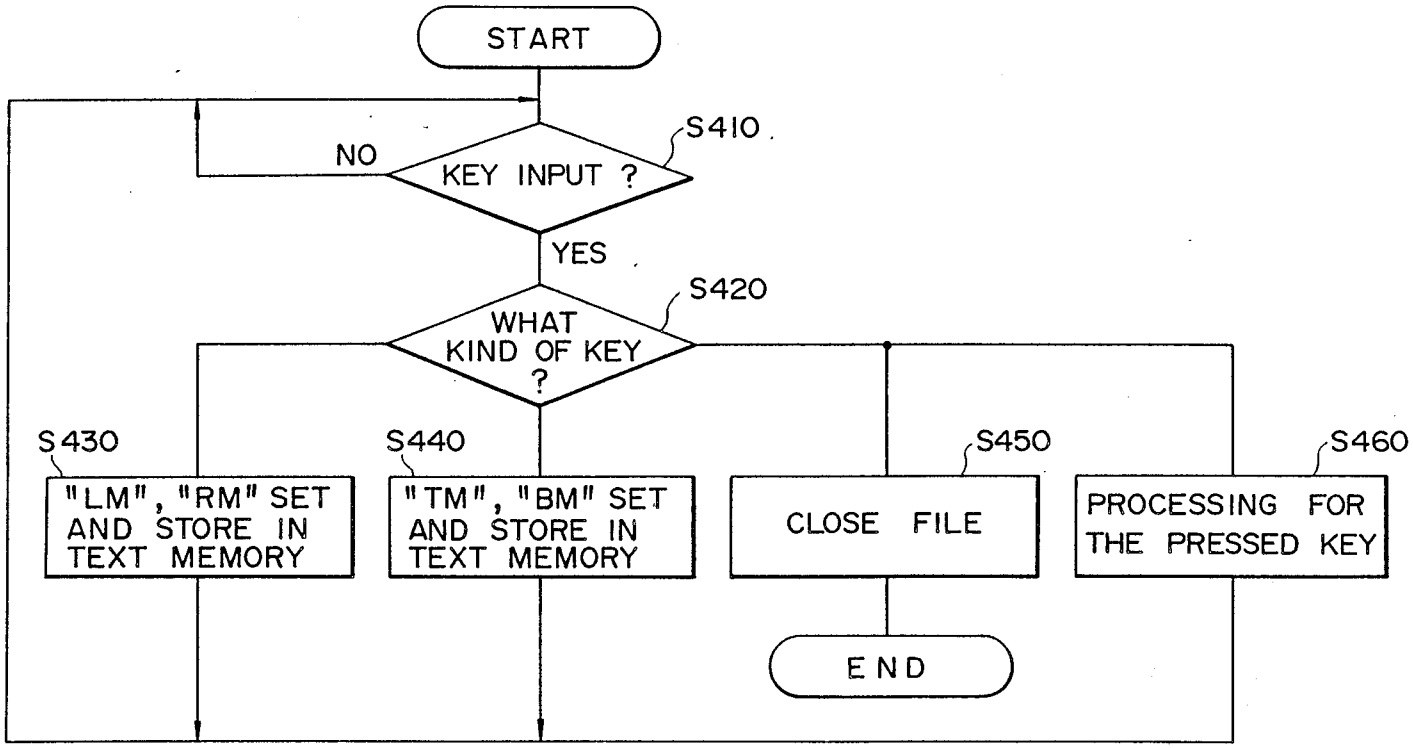

Preparing a text data file with the present electronic typewriter is executed by the processing shown in FIG. 4. When there is a key entry (S410), it is examined through which the entry has been done (S420). (1) If it is through the line format key **18*e*, the operator now moves the print hammer 28 (the carriage 10) to a desired position by means of key operation and presses the right and left margin set key 18*c*. The left margin data (LM) and the right margin data (RM) given by the current position of the print hammer 28 (the carriage 10) are then set up and stored in text memory (S430). (2) If the entry is through the print format key 18*e*, the operator similarly drives the platen 21 by means of key operation and feeds the paper 6 to a desired position, then entering the top and bottom margin key set 18*d*. The top margin data (TM) and the bottom margin data (BM) are now set up and stored in text memory (S440). (3) If it is through the end key 18*f*, the file is closed to terminate the processing (S450). (4) If it is through any other key than above, the processing assigned to the key is executed (S460). If it is one of the character keys 8** for instance, the character entered is placed in a buffer and then stored in the memory, or printed accordingly.

If it is necessary to change the line format data or the page format data having been already set, a format data changing processing is executed by means of the procedures (S430 or S440) described above.

Figure 3A:
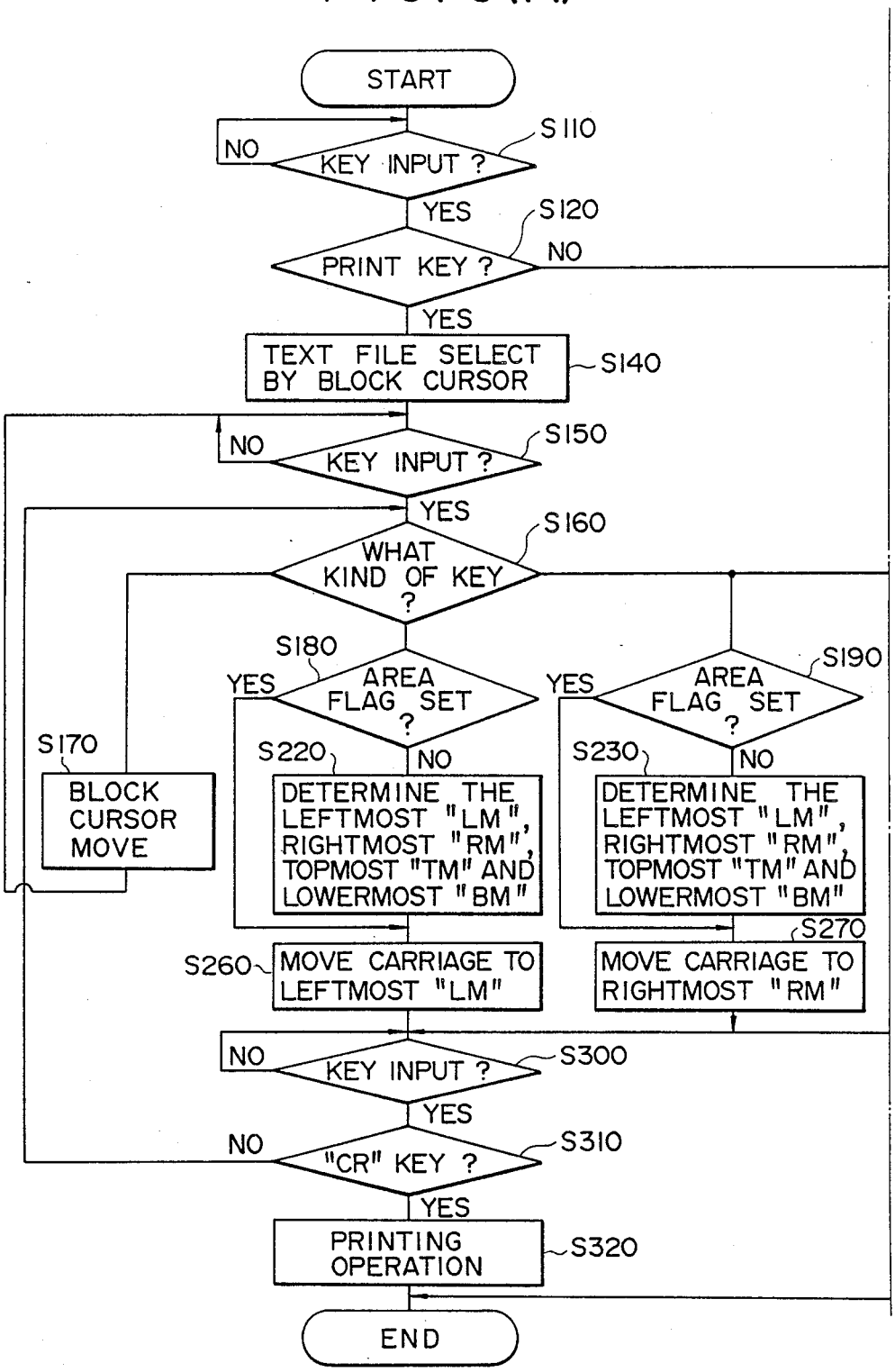

Referring back to the description of FIG. 3, when the leftmost, rightmost, topmost and lowermost margins are determined or already given (S220 through 250), the carriage 10 is moved to the leftmost, rightmost, topmost and lowermost margins after going through examination in steps S180 through S210 (S260 through S290). When moving it to the leftmost or rightmost margin, the stepping motor 38 is driven to move the carriage 10 to right and left so that the print hammer 28 is brought to the position at which a printed character appears at the leftmost or rightmost column, in case that, the file in question is completely printed. When moving it to the topmost or lowermost margin, the stepping motor 39 is driven to feed the print sheet 6 so that the print hammer 28 is brought to the position at which the starting line or ending line appears on the print sheet 6 in case that the file in question is completely printed.

Thereafter, the processing is brought to a key awaiting state (S300). If the return key 16 is pressed in this state (S310), printing the file is executed (S320). If the entry is through any other key, the processing jumps to S160 to effect the processing assigned to the key depressed.

Since the electric typewriter 1 is arranged as described above, the print hammer 28 can be moved to the leftmost, rightmost, topmost or lowermost end of the print area before effecting actual printing, thus allowing the operator to check for the correct print area. This enables the operator to select a proper size or type of the sheet in advance so as to avoid waste of sheet and printing time.

Figure 5A:
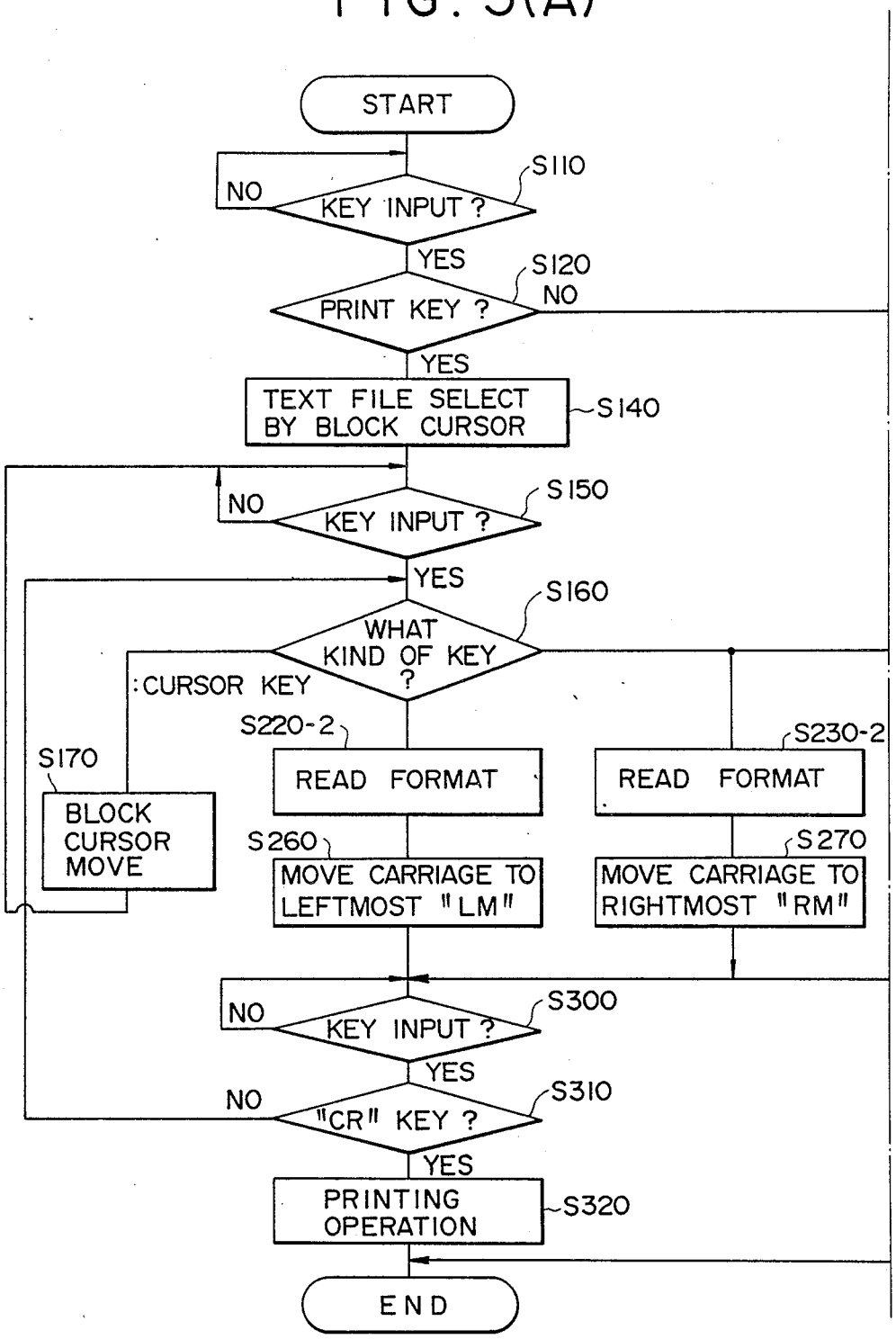
Figure 6:
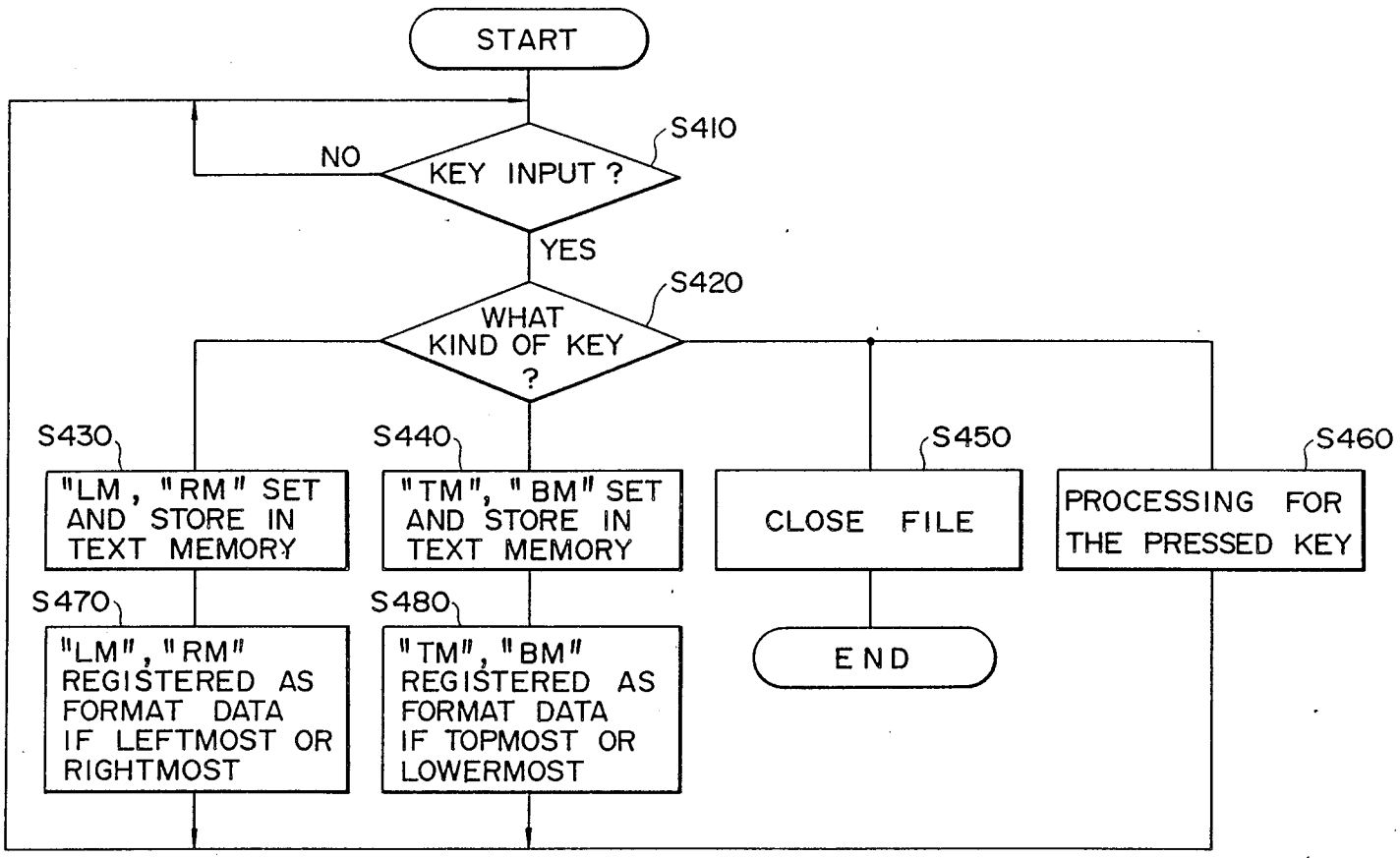

An another embodiment of the invention is now described below. The difference from the above embodiment lies only in the processings executed in the electronic control circuit 50, with an identical arrangement of the hardware with that of the first embodiment. Therefore explanation is given only for the processing, which is shown in FIGS. 5 and 6. The processing in FIG. 5 is different from that in FIG. 3 only in that the steps S180 through S210 are eliminated and format reading processing for the file in question (S220-2 through 250-2) replaces the steps S220 through S250. The processing in FIG. 6 is different from that in FIG. 4 only in that, after steps S430 and S440, a routine is added to store the leftmost, rightmost, topmost or lowermost margin in the starting format when such margin is given (S470, 480).

The aforementioned steps S470 and S480 are provided to store the outermost peripheral positions of a particular print area of a text file. This processing makes the file data configuration shown in FIG. 8(B) available. This data configuration is different from that in the above embodiment shown in FIG. 8(A) in that the starting format data 72-2 contains, after the bottom margin data (BM) **72*e*, a leftmost margin data (MLM) 72*f*, a rightmost margin data (MRM), a topmost margin data (MTM) and a lowermost margin data (MBM). In carrying out the steps S220-2 through S250-2 shown in FIG. 7, only reading this data allows the carriage 10 to be moved to a corresponding position on the sheet 6 by driving the stepping motors 38 and 39**. This provides the same result as in the above embodiment.

Figure 7A:
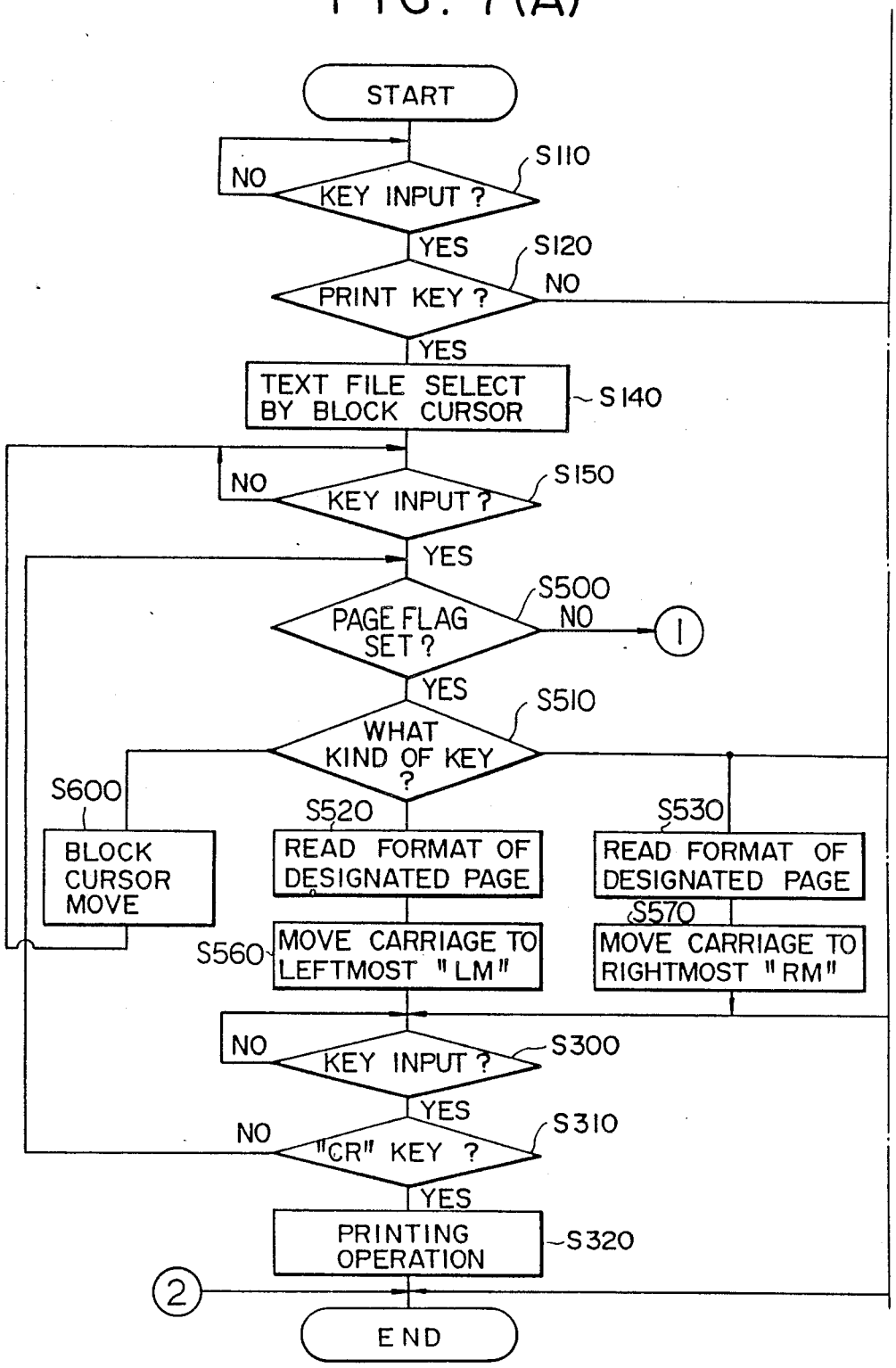
Figure 7B:
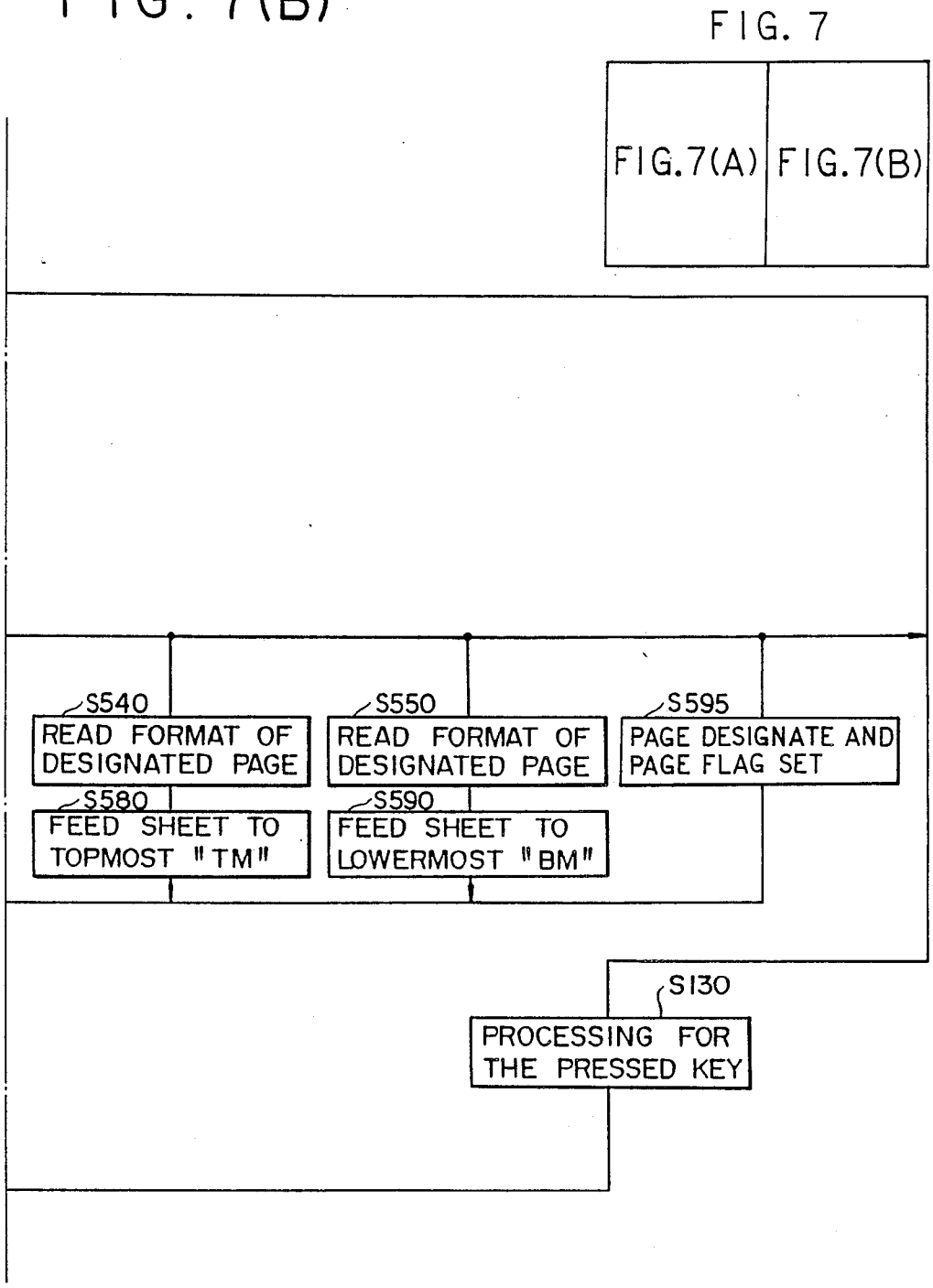
Figure 7C:
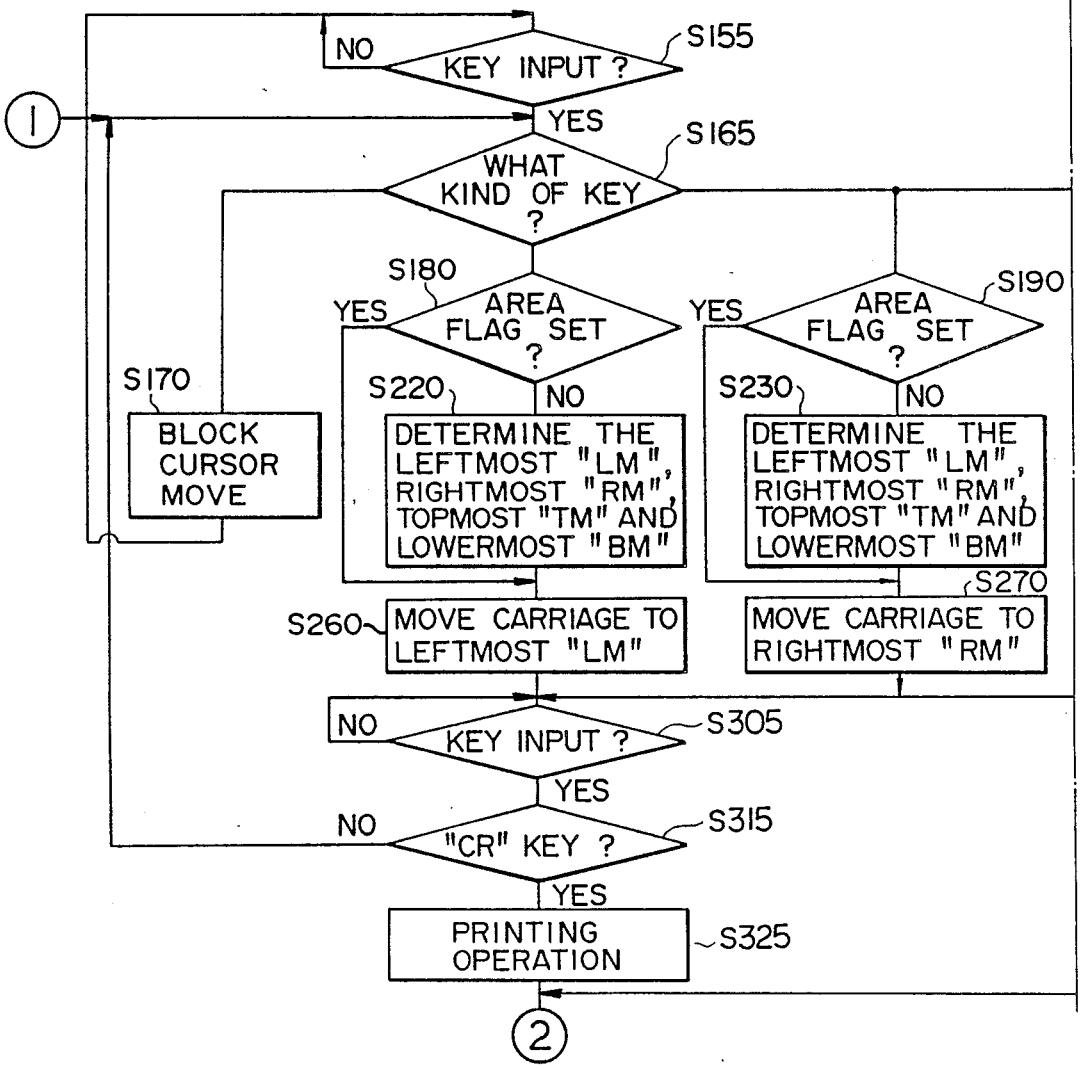
Figure 7:
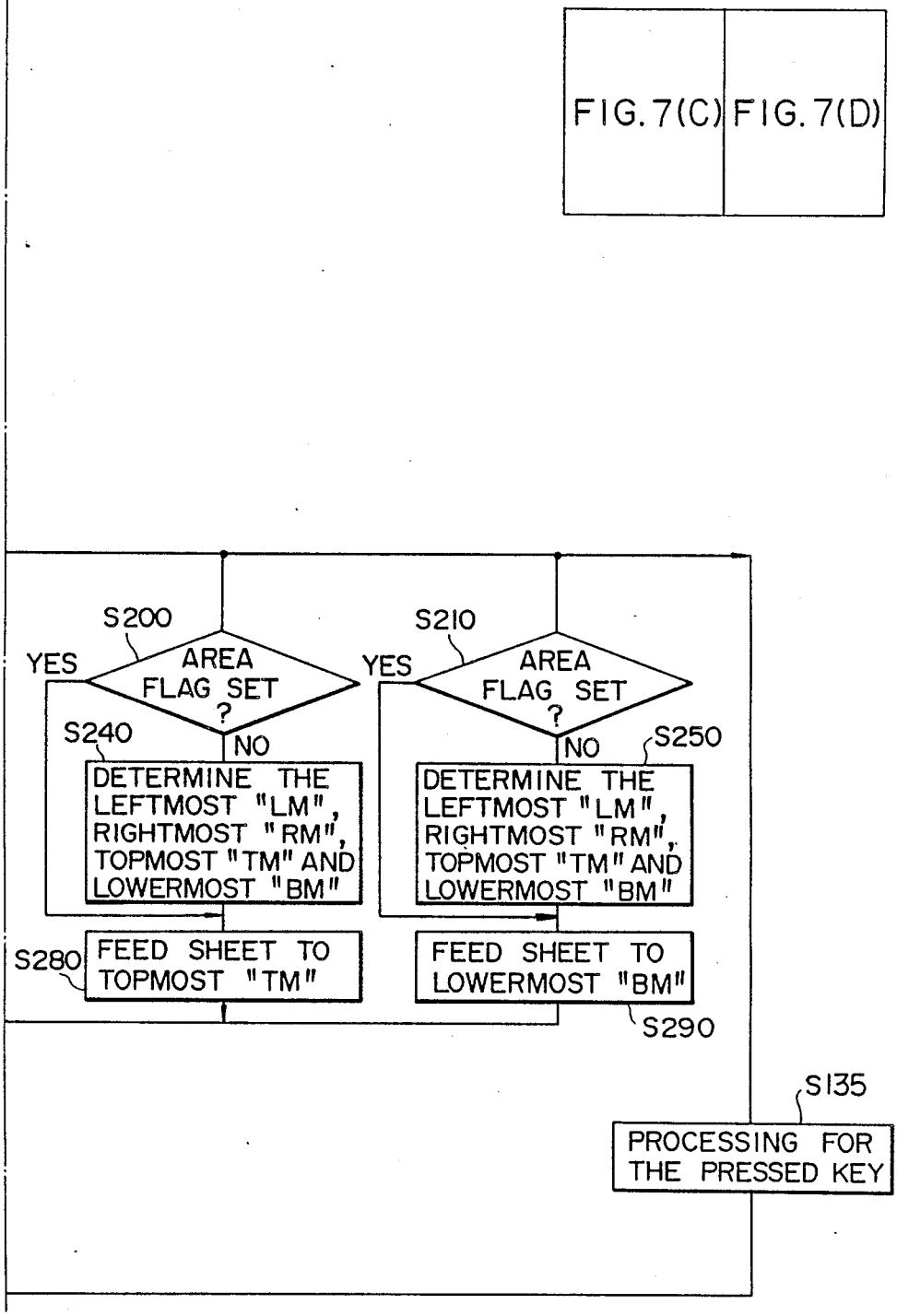
Figure 8B:
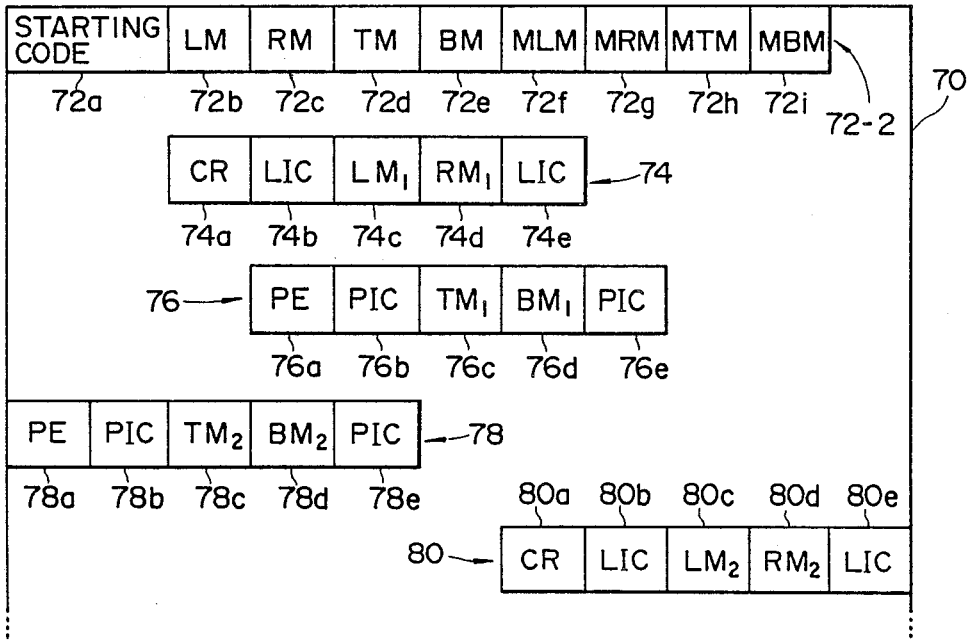

While in the aforementioned embodiments, the carriage 10 is moved to the peripheral positions of the print area for each text file, this processing may be executed for each page. In this case, the leftmost margin data (MLM) **72*f*, the rightmost margin data (MRM), the topmost margin data (MTM) and the lowermost margin data (MBM) within one page are to be determined in the steps S220 through S250 shown in FIG. 5. In actual operation, as shown in FIG. 7, the arrangement may be such that, as soon as the step S500 determines whether a page flag is set or not. If it is determined "YES", the processing becomes ready for a page specifying instruction so that the carriage 10 indicates the peripheral printing positions only for the page specified by the operator. If it is determined "NO", the outermost peripheral positions of the selected file are determined. An alternative arrangement may be such that, each time the step S510 determines the key entry to be through the margin key 18*b* or 18*g***, a specially provided page counter is incremented to sequentially show the peripheral printing positions for all the pages.

Instead of page-based operation, the format data 72 to 80 shown in FIG. 8(A) may be indicated by the carriage 10 from its beginning, regardless of what the page number is.

It is to be noted that the present invention is not limitted to these embodiments but various other embodiments and modifications are possible without departing from the subject matter of the invention.

What is claimed is:

1. A printing device comprising:

memory means having text files stored therein;

select means for selecting one of stored text files to be printed;

printing means including a print head unit for printing onto a print area of a print sheet the content of the text file selected by said select means:

searching means for searching in said text file selected by said select means for the most outside peripheral positions of data to occupy the print area; and controlling means for controlling at least one of said printing means and said print sheet so as to place said print head unit at the positions corresponding to the most outside peripheral positions relative to said print sheet in response to said searching means without printing out said selected text file.

2. The printing device according to claim 1, wherein said control means further controls said print means so as to place said print head unit at positions corresponding to the the peripheral position data other than said most outside peripheral position data.

3. The printing device according to claim 1, wherein said outside peripheral positions of the print area comprise a left margin, a right margin, a top margin and a bottom margin.

4. The printing device according to claim 1, wherein said select means comprises a liquid crystal panel for displaying the names of said text files.

5. The printing device according to claim 4, wherein said select means further comprises a block cursor being displayed on said liquid crystal panel to be located under the name of text file to be selected.

6. The printing device according to claim 1 which further comprises format input means for inputting peripheral position data into the text file selected by said select means.

7. A printing device for printing on a print sheet one of text files stored in memory means, said text files including data corresponding to outside most peripheral positions of the print area to be occupied by printouts thereof said printing device comprising:

select means for selecting one of text files to be printed.

printing means including a print head unit for printing the content of said one text file selected by said select means; and controlling means for controlling at least one of said printing means and said print sheet so as to place said print head unit at positions corresponding to the most outside peripheral positions data stored in said memory means relative to said print sheet without printing out said one text file.

8. The printing device according to claim 7, which further comprises format input means for inputting peripheral position data into the text file selected by said select means.

9. A printing device for printing onto a print sheet text files stored in memory means, said printing device comprising:

select means for selecting one of said text files to be printed, printing means including a print head unit for printing the content of the text file selected by said select means;

page designate means for designating a page of the selected file and storing the number of the page designated;

searching means for searching in said designated page of said text file selected by said select means for data of most outside peripheral positions and controlling means for controlling at least one of said printing means and said print sheet so as to place said print head unit at positions corresponding to said most outside peripheral positions without printing out said selected text file.

10. The printing device according to claim 9 wherein said search means further searches for most outside peripheral position data of pages other than said page designated by said page designate means.

11. The text printing device according to claim 9, which further comprises counter means for increasing the page number stored in said page designate means after said print head is placed to the positions corresponding to the most outside peripheral position data.

12. The printing device according to claim 9, which further comprises format input means for inputting peripheral position data into the text file selected by said select means.

* * * * *